US005865112A

United States Patent [19]

Grabscheid et al.

[11] Patent Number: 5,865,112

[45] **Date of Patent: *Feb. 2, 1999**

[54] EXTENDED NIP PRESS

[75] Inventors: Joachim Grabscheid, Heuchlingen; Udo Grossmann, Heidenheim, both of Germany

[73] Assignee: Voith Sulzer Papiermaschinen GmbH, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 737,900

[22] Filed: Nov. 20, 1996

Related U.S. Application Data

[63] Continuation of PCT/EP95/01848, May 16, 1995.

[51] Int. Cl.[6] ..... B30B 3/04; D21F 3/00

[52] U.S. Cl. ..... 100/168; 100/153; 100/176; 162/358.3

[58] Field of Search ..... 100/121, 153, 100/155 R, 168, 171, 176; 162/358.3

[56] References Cited

U.S. PATENT DOCUMENTS

| | | | |
|---|---|---|---|
| 3,921,514 | 11/1975 | Biondetti . | |
| 4,272,317 | 6/1981 | Roerig . | |
| 5,291,826 | 3/1994 | Schiel | 100/153 |
| 5,305,689 | 4/1994 | Schiel | 100/176 |
| 5,385,088 | 1/1995 | Grabscheid | 100/153 |
| 5,395,172 | 3/1995 | Grabshceid | 100/168 |
| 5,399,242 | 3/1995 | Schiel | 100/168 |
| 5,400,708 | 3/1995 | Meschenmoser | 100/153 |
| 5,404,811 | 4/1995 | Schiel et al. | 100/153 |
| 5,413,036 | 5/1995 | Schiel | 100/168 |
| 5,507,223 | 4/1996 | Vallius | 100/153 |
| 5,538,228 | 7/1996 | Schiel . | |

FOREIGN PATENT DOCUMENTS

| | | | |
|---|---|---|---|
| 0027621 | 4/1981 | European Pat. Off. | 100/168 |
| 0328844 | 8/1989 | European Pat. Off. | 100/153 |
| G 8232424 U | 10/1985 | Germany | 100/153 |
| 4102356 | 1/1992 | Germany | 100/168 |
| G9204405 U | 7/1992 | Germany . | |
| 4231472 | 4/1993 | Germany | 100/176 |

*Primary Examiner*—Stephen F. Gerrity
*Attorney, Agent, or Firm*—Ostrolenk, Faber, Gerb & Soffen, LLP

[57] ABSTRACT

An extended nip press for dewatering a pulp web has two press rolls that form an extended nip. The first press roll is retained in the axial direction at least at one end, and is held with its bearing pins on first bearing blocks. The second press roll is also held with its bearing pins on second bearing blocks. The second bearing blocks can be tensioned, each in pairs, with respect to the first bearing blocks by flexurally elastic tension elements, the tension elements allowing a relative displacement of the press rolls in the axial direction. The second bearing blocks are fixed in position with respect to the first bearing blocks in order to prevent excessive bending stress on the tension elements. For this purpose, either the rotary bearings of the second press roll are configured in non-tilting fashion, or additional support bearings are provided.

26 Claims, 8 Drawing Sheets

40

EXTENDED NIP PRESS

CROSS REFERENCE TO RELATED APPLICATION

This application is a continuation application of international application PCT/EP95/01848, with an international filing date of May 16, 1995 (now abandoned).

BACKGROUND OF THE INVENTION

The present invention relates to an extended nip press for dewatering a pulp web in a paper-making machine which comprises two press rolls that form a press nip, the first press roll being retained in the axial direction at least at one end, and having first bearing blocks to hold first bearing pins of the first press roll, and having second bearing blocks to hold second bearing pins of the second press roll, and having tension elements by means of which the second bearing blocks can each be tensioned with respect to the first bearing blocks, the tension elements allowing a relative displacement of the press rolls in the axial direction.

An extended nip press of this kind is known from WO 92/17641.

In the known press apparatus, two press rolls, between which a press nip is formed, are arranged parallel to one another.

Since the first bearing blocks and the second bearing blocks are tensioned with respect to one another by means of tension elements, the result is a short force flow path for transfer of the pressing force in the press nip which does not stress any of the frame parts. The frame must therefore transfer only the dead weight of the press, but not the high pressing forces. The result is therefore a simpler, lighter, and more space-saving construction. In the known press apparatus, the tension elements consist of a center part similar to a leaf spring, and hammer-heads at the ends which are held in grooves on the bearing blocks. The bearing blocks are thus connected directly by means of the aforesaid tension elements. The tension elements, which are flexurally elastic in the axial direction of the press rolls, thus allow mutual deflection of the press rolls and a certain mutual axial displaceability of the press rolls during operation due to high pressing forces or due to changes in length which may, for example, be caused by temperature. When the press apparatus is unloaded, the tension elements are preloaded either not at all or only very slightly.

In the known apparatus, the first press roll is configured as a deflection compensated roll, i.e. the roll possesses a stationary supporting member or a yoke on which is rotatably mounted a roll shell that is hydraulically braced on the yoke, so that even when extraordinarily high pressing forces are present during operation, the roll shell can be adjusted to have practically deflection-free characteristics or even, if desired, to have a specific deflection, the yoke being capable of deflecting. At the same time, this considerably simplifies the construction of the bearings. In the known arrangement, the second press roller is configured as a shoe press roll, which again has a stationary supporting member over which a tubular pressing shell circulates. In the region of the press nip, this pressing shell runs over a press shoe which is adapted to the shape of the opposing roll, i.e. the first press roll which is embodied as a deflection compensated roll, thereby forming an extended press nip. Thus, an extraordinarily high pressing force can be generated in the region of the press nip, and at the same time a gradual increase in pressure upon entry into the press nip is possible.

When the width of the pulp web is smaller, in many cases the deflection compensated roll is replaced by a quasi-deflection-free solid roll, since the load is lower.

However, it has been found that in certain cases the tension elements of this pior art design may be subject to premature failure.

SUMMARY OF THE INVENTION

It is an object of the invention to develop an improved extended nip press which reduces the maximum load to which the tension elements can be exposed during operation.

It is a further object of the invention to provide an extended nip press in which the tension elements have a longer life time than in prior designs.

According to the invention, these and other objects are achieved in that means are provided for accommodating tilting moments which are exerted during operation on the second bearing blocks of the second press roll.

The object of the invention is completely achieved in this manner. Specifically, it was recognized according to the invention that in the aforementioned prior art extended nip press, when the deflection compensated roll is retained on the first press roll solely by means of the tension elements, the result is a four-link system in which the yoke of the second press roll, which is configured as a deflection compensated roll, deflects considerably during operation as a result of the high pressing forces. This deflection results in skewing of the stationary bearing pins. In conventional arrangements this skewing would be transferred to the bearing blocks because of the relatively high friction yoke bearing points in the spherical bushings, thus causing relatively severe tilting of the bearing blocks with respect to the tension elements and therefore extreme bending stress. According to the invention, this bending stress is avoided by providing means for accommodating the tilting moment exerted on the second bearing blocks. Thus according to the invention the position of the bearing blocks is defined with respect to the tension elements by the fact that the bearing blocks can no longer follow the highly inclining bearing pins of the yoke, but instead are adapted to the position of the roll shell, which because of the hydraulic bracing of the roll shell on the yoke deflects very little or not at all. The result, according to the invention, is that even under severe load, the bearing blocks experience only a very slight tilting with respect to the tension elements, so that the bending stresses exerted on the tension elements do not exceed permissible values.

According to the invention it was furthermore recognized that even in the event when the second press roll is configured not as a deflection compensated roll but rather (for example when the machine width is less) as a quasi-deflection-free solid roll, considerable bending moments can be exerted on the tension elements if the second press roll is retained on the first press roll solely by means of the tension elements. The reason is that if external accessories—for example scrapers, felt guide rolls, or the like—are installed directly on the bearing blocks of the second press roll, in the case of conventional arrangements this would lead to an additional bending load on the tension elements. External accessories of this kind require non-locating bearings on the one side so that changes in length during operation with respect to the second press roll can be compensated for. This length compensation is attended by some degree of friction and, when compensation movements occur, generates tilting moments about the center point of the rotary bearing. In the axial direction of the second press roll these tilting moments cannot be accommodated by the flexurally soft tension elements, and in the case of conventional arrangements therefore lead to uncontrolled skewing of the bearing blocks and thus to excessive bending stress on the tension elements. According to the invention the bending load is greatly reduced in this instance as well, specifically by the fact that means are provided for accommodating the tilting moments exerted on the second bearing blocks. In this case the bearing blocks are retained directly on the rotatable bearing pins, since the bearing pins experience only a slight inclination during the relatively small deflection of the solid roll.

Theoretically there are a number of possible ways in which the tilting moments exerted on the second bearing blocks can be accommodated.

According to a first proposal of the invention, an additional support bearing is provided alongside each rotary bearing of the second press roll in order to hold the bearing blocks in non-tilting fashion.

At present, because of the large forces accommodated by the bearing pins and because of the large skewing of the bearing pins, the rotary bearings are preferably configured as self-aligning bearings which cannot transfer tilting moments, i.e. which allow tilting of the bearing blocks. According to the invention, however, an additional support bearing results in non-tilting bracing of the bearing blocks with respect to the rotatable roll shell, if the second press roll is configured as a deflection compensated roll.

If, on the other hand, the second press roll is configured as a solid roll, the result of the additional support bearings is to fix the bearing blocks in position on the rotating bearing pins of the solid roll.

According to another proposal of the invention, the rotary bearings themselves can be configured as bearings which can accommodate the tilting moments. For example the rotary bearings can be configured as double-row tapered roller bearings in a zero arrangement, so that the bearing blocks are fixed in their angular position, without additional support bearings, directly on the roll shell or on the bearing pins of the solid roll. The advantage of this embodiment is that an additional support bearing can be omitted.

In addition, there are further possibilities for achieving accommodation of the tilting moments on the second bearing blocks. For example the second bearing blocks can be connected to one another by a crossmember, thus eliminating tilting. Moreover it is conceivable to fix the bearing blocks in their position relative to the frame with additional devices, for example with coupling rods, brackets, guides, and the like in order to prevent tilting of the bearing blocks.

One possibility for achieving accommodation of the tilting moments on the second bearing blocks consists in the fact that provided on the second bearing blocks are links which are each rigidly fastened with a first end to the second bearing blocks, and which each engage with a second end on a stationary guide, which secures the respective second end against displacements in the axial direction, but permits displacements in the vertical direction.

This type of guidance of the second bearing blocks by means of links on the base or the chassis also makes it possible to eliminate tilting of the second bearing blocks and thus excessive bending loads on the tension elements.

According to a further embodiment of the invention, a link is provided on only one of the two bearing blocks, and is rigidly fastened at a first end to one of the two bearing blocks and engages with a second end on a stationary guide which secures the second end against displacements in the axial direction but permits displacements in the vertical direction, the second bearing blocks being coupled to one another via a horizontal connecting element.

In this fashion only one of the two bearing blocks needs to be secured against axial displacements by means of a link, while a link of this kind can be omitted on the other second bearing block because it is connected to the first of the two bearing blocks.

In an alternative embodiment, the links can also be guided on the first bearing blocks. An embodiment of this kind is preferred when the first press roll is mounted directly (without spherical bushings) on the first bearing blocks.

According to a further embodiment of the invention, the first bearing blocks are coupled to the respective second bearing blocks by substantially vertical brackets, the brackets being configured as rigid connecting elements that are connected at their respective ends, via articulated joints, to the second bearing blocks and the first bearing pins, the spacing between the brackets and the tension elements being dimensioned such that when the press apparatus is under load, the change in length of the tension elements—resulting in each case from, for example, the pressing force—corresponds to the displacement of the engagement points of the respective bracket caused by the deflection of the roll ends.

Instead of retaining the second bearing blocks on the base or on the first bearing blocks by means of links that are displaceably guided, in this manner the first bearing blocks can be connected in articulated fashion to the second bearing blocks by means of brackets. The prerequisite for this, however, is that these brackets be arranged at a spacing from the tension elements such that length increases in the tension elements occurring under load are compensated for by a corresponding displacement of the engagement points of the respective bracket that results from deflection of the roll ends.

As a variation of this, a bracket of this kind can also be provided only between one respective first and second bearing block, while securing of the bearing blocks to the opposite side of the press apparatus is once again achieved by the fact that the second bearing blocks are coupled to one another via a horizontal connecting element.

According to a further proposal of the invention, at least one of the second bearing blocks is secured against displacements in the axial direction to one of the first bearing blocks.

The result of this is that the second press roll is no longer, as in the case of the known arrangement, retained in the axial direction directly on the machine chassis, but rather is now guided in the axial direction on the bearing block of the first press roll. As a result the bending load on the tension elements that can occur due to axial forces on the press roll retained by the tension elements is considerably reduced, since the bending stress can no longer occur only on one side, but is distributed in defined fashion over the length of the tension elements.

In a preferred development of the invention, one of the second bearing blocks is coupled to the first bearing block by means of an articulated connection that is fixed in the axial direction of the press rolls, but movable in the longitudinal direction of the tension elements.

Axial retention of the second bearing block on the first bearing block can be achieved particularly easily in this fashion.

According to a further embodiment of the invention, the articulated connection is arranged approximately in the middle of the longitudinal extension of the tension element.

The advantage of this feature is that the maximum bending load on the tension elements is further reduced, since only half the bending stress can occur at each immovably clamped end of a tension element. Thus for a given dimensioning of the tension elements, even greater deflections of the press rolls under the load in the press nip can be handled, since the bending loads resulting therefrom are distributed evenly to both ends of the tension elements.

A particularly simple embodiment for the articulated connection results if it comprises a pin which is held, displaceably in the vertical direction, inside a guide.

According to an alternative embodiment of the invention, one of the second bearing blocks is coupled to one of the first bearing blocks by means of a gated guide that is movable in the vertical direction.

This therefore results, instead of a sliding articulated connection of the aforesaid kind, in a simplified connection between the two bearing blocks, since the gated guide can be provided directly between the bearing blocks so that when the press apparatus is not under load, it can simultaneously perform a support function between the two bearing blocks.

A further embodiment of the invention provides for the drive-side bearing blocks to be retained relative to one another by means of the articulated connection.

The advantage of this feature is that the articulated connection is not in the way when a press shell belonging to one of the two press rolls is changed, or when an endless felt belt guided through the press gap is changed.

It is understood that the features mentioned above and those yet to be explained below can be used not only in the respective combinations indicated, but also in other combinations or in isolation, without leaving the context of the present invention.

SHORT DESCRIPTION OF THE DRAWINGS

Some preferred embodiments of the invention will be explained in more detail below with reference to the drawings, in which.

DETAILED DESCRIPTION OF THE PREFERRED EMBODIMENTS

Figure 1:
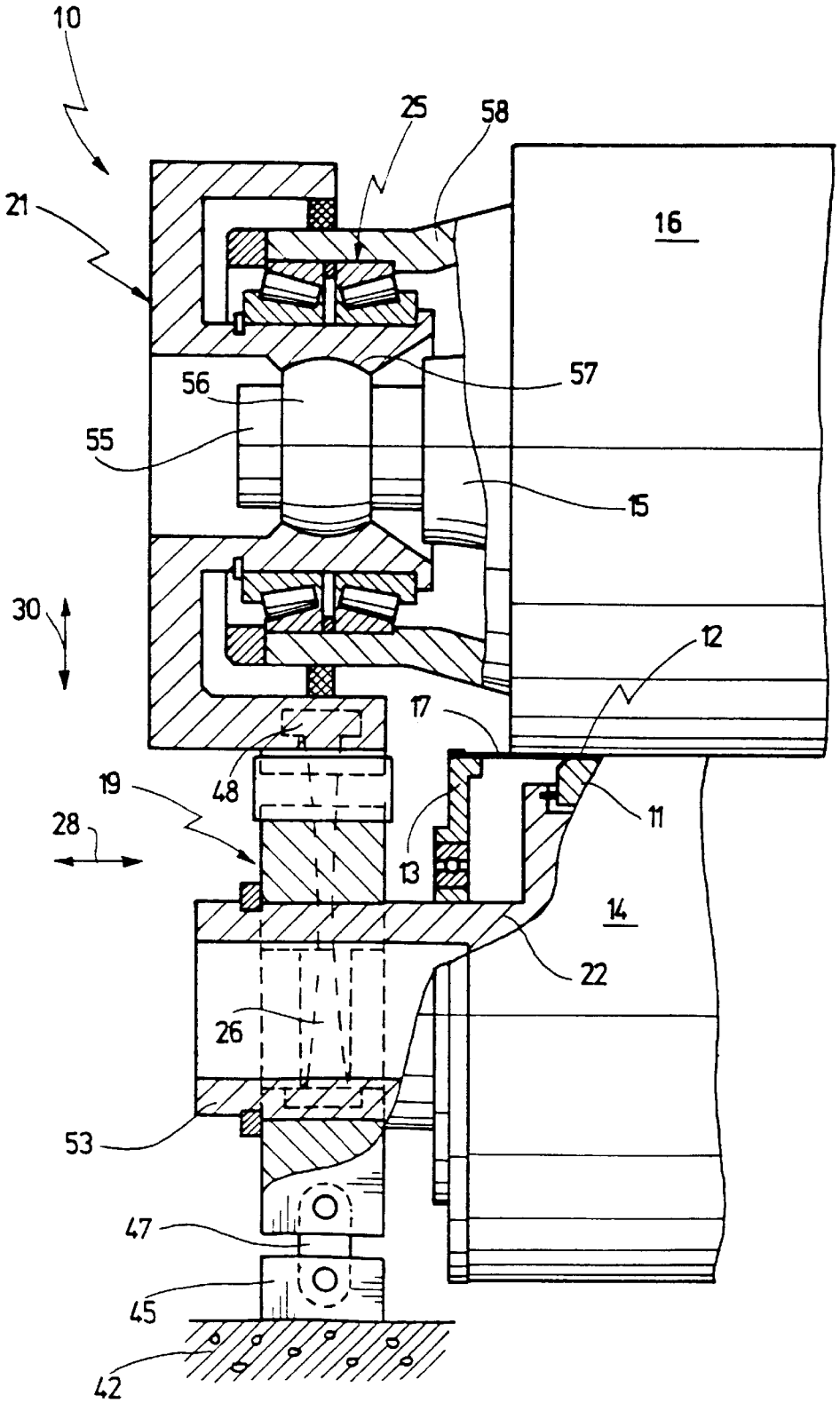
FIG. 1 shows the guide side of a press apparatus according to the invention, in a partly sectioned front view.
Figure 2:
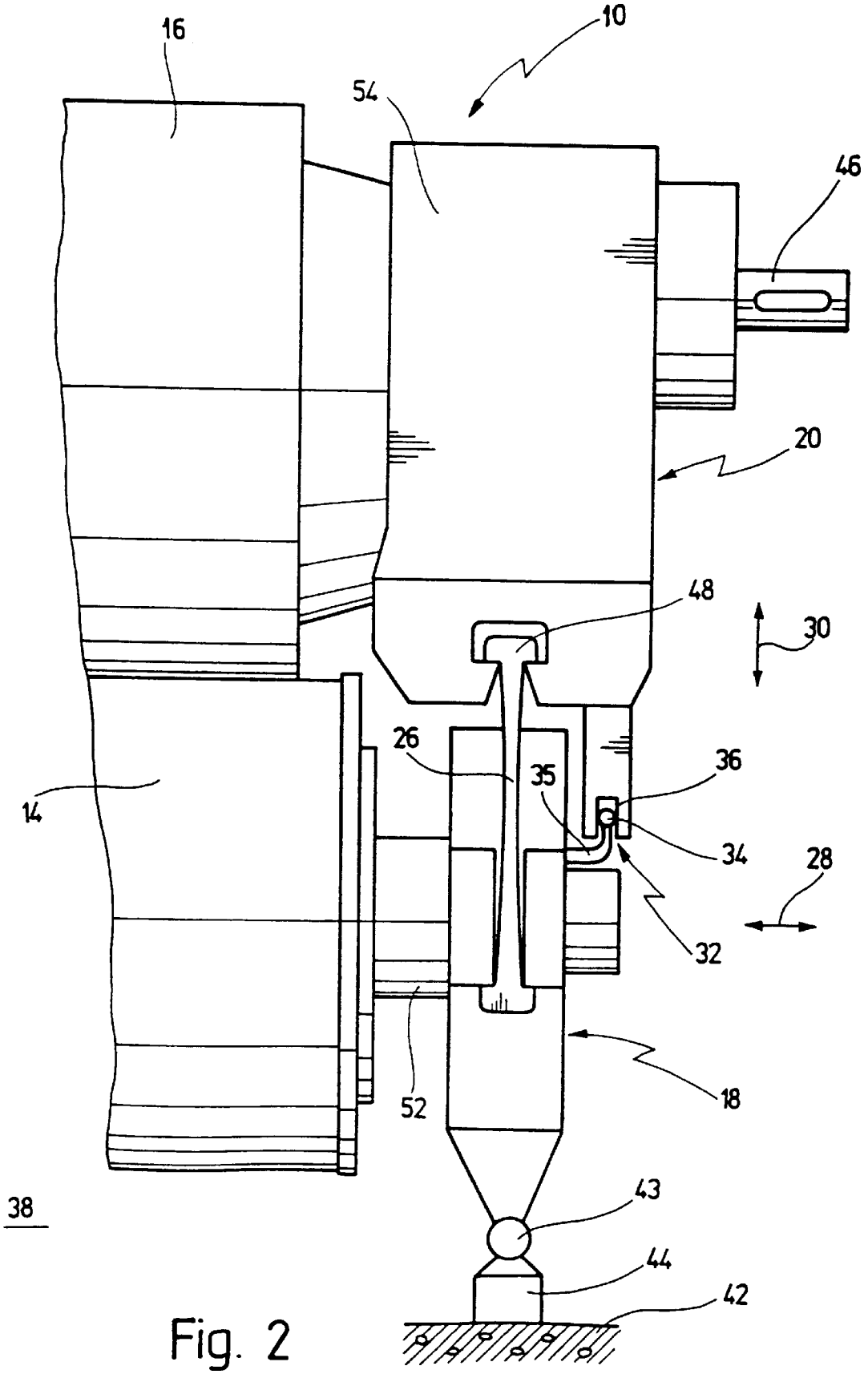
FIG. 2 shows the drive side of the embodiment according to FIG. 1.

In FIGS. 1 and 2, a press apparatus according to the invention is indicated generally by reference numeral 10.

Press apparatus 10 comprises a first press roll 14 that is configured as a shoe press roll with a press shoe 11 that can be pressed on hydraulically, as well as a second press roll 16 arranged above the first press roll 14 and parallel thereto, which is configured as a deflection compensated roll. The construction of a deflection compensated roll and a shoe press roll is fundamentally known, reference being made, for example, to U.S. Pat. No. 5,338,279, the disclosure of which is fully incorporated by reference.

First press roll 14 comprises, in a manner known in the art, a pressing shell 17 that is rotatably mounted, by means of support plates 13, on a stationary supporting member 22 and can be pressed hydraulically by means of press shoe 11 against second press roll 16. A press nip 12 through which a pulp web being dewatered, together with usually at least one felt web, is guided (not depicted) is thus formed between first press roll 14 and second press roll 16.

First press roll 14 is mounted rigidly, with the two first bearing pins 52, 52 of stationary support member 22, on first bearing blocks 18, 19.

First bearing block 18 is retained on drive side 38, nondisplaceably in the axial direction, by means of a locating bearing.

For this purpose, first bearing block 18 is connected via an articulated joint 43 to chassis 44 which is fastened onto a base 42. Thus on drive side 38, only swiveling or skewing of first bearing block 18 is possible, but no movement in axial direction 28. On guide side 40, however, first bearing block is retained displaceably in the axial direction by means of a "non-locating bearing." For this purpose, bearing block 19 is connected to chassis 45 by means of a double articulated joint 47 (cf. DE 42 10 685 C1) that is fastened to the base. When support element 22 deflects, bearing blocks 18, 19 can skew in accordance with the skewing of bearing pins 52, 53.

Second press roll 16, configured as a deflection compensated roll, has a stationary yoke 15 whose two ends are configured as bearing pins that are mounted in two bearing blocks 20, 21. For this purpose, as is evident from FIG. 1, each bearing pin 55 has a collar 56, with a convex outer surface, that is pivotably mounted in a correspondingly shaped bushing 57 in order to allow pivoting movements of bearing pin 55 as yoke 15 deflects when a load is present. Second bearing blocks 20, 21 of second press roll 16 are retained in respective pairs, with tension elements 26, on first bearing blocks 18, 19 located below.

While tension elements 26 are under no preload or very little preload when in the resting state, under load, when press shoe 11 is pressed against second press roll 16, they accommodate the load and transfer it directly to first bearing blocks 18, 19. A direct transfer of force from second bearing blocks 20, 21 via tension elements 26 to first bearing blocks 18, 19 under load is thus guaranteed.

Furthermore, axial displacement between first press roll 14 and second press roll 16 under load is always possible. Second press roll 16 has a roll shell 58 that is rotatably mounted at its two ends on second bearing blocks 20, 21 by means of rotary bearings, and is hydraulically braced against yoke 15.

According to the invention the rotary bearings are configured as bearings that can accommodate tilting moments. Rotary bearing 25 depicted in FIG. 1 is configured as a double-row tapered roller bearing in an O arrangement, thus guaranteeing that the second guide-side bearing block 21 is aligned with the end of roll shell 58. The same applies to drive-side bearing block 20.

Since second press roll 16 is configured as a deflection compensated roll, bearing pins 55 deflect under load, while roll shell 58 is hydraulically braced against yoke 15, i.e. is largely deflection-free or exhibits a desired (small) deflection. Under load, the ends of roll shell 58 thus skew much less than second bearing pins 55. Since, when yoke 15 deflects, considerable frictional forces are transferred in each case from collar 56 to bushing 57 and to second bearing blocks 20, 21, without the non-tilting configuration of the rotary bearings second bearing blocks 20, 21 would tilt along with bearing pins 55, since tension elements 26, which are flexurally soft in the axial direction of press roll 16, cannot accommodate these frictional forces, which would thus lead to severe bending loads on tension elements 26.

The ability of the rotary bearings to accommodate tilting moments eliminates this tilting, and second bearing blocks 20, 21 are fixed in position at the ends of roll shell 58. Excessive and undefined bending loads on tension elements 26 under load are thus prevented.

As is evident from FIG. 2, the second drive-side bearing block 20 is moreover connected by means of a sliding articulated connection 32 to the first drive-side bearing block 18. This articulated connection 32 consists in the simplest case of an arm 35 that is fastened to bearing block 18 approximately in the middle of the longitudinal extension of tension element 26. Located at the end of arm 35 is a pin 34 that is held in rotationally movable fashion inside a guide 33 extending in vertical direction 30, and is displaceable in vertical direction 30. Guide 36 is rigidly connected to the second drive-side bearing block 20. The second drive-side bearing block 20 is thus retained in axial direction 28 on first bearing block 18 located beneath, but can move in vertical direction 30, to the extent that, for example, tension elements 26 elongate under load. Skewing of bearing block 18 is also possible.

Because second press roll 16 is retained via articulated connection 32 on drive side 38 on first bearing block 18, the bending stress exerted on tension elements 26 during operation is minimized and, when articulated connection 32 is arranged in the middle of the longitudinal extension of tension elements 26, is distributed uniformly between the ends of tension elements 26.

Since tension elements 26 themselves are configured resiliently in axial direction 28 and therefore can accommodate only very small transverse forces, articulated connection 32 thus results in retention of second press roll 16 in the axial direction with respect to first press roll 14, and at the same time bending stresses on tension elements 26 are uniformly distributed between the ends of tension elements 26. This therefore also prevents, in tension elements 26, those bending stresses that are caused by axial forces acting on second press roll 16.

As is evident from FIG. 2, tension elements 26 have at their two ends, in a manner known in the art, hammerheads 48 with which they are held in T-shaped grooves of the second bearing blocks, while they engage with their lower hammerheads in simple grooves of first bearing blocks 18, 19.

Figure 3:
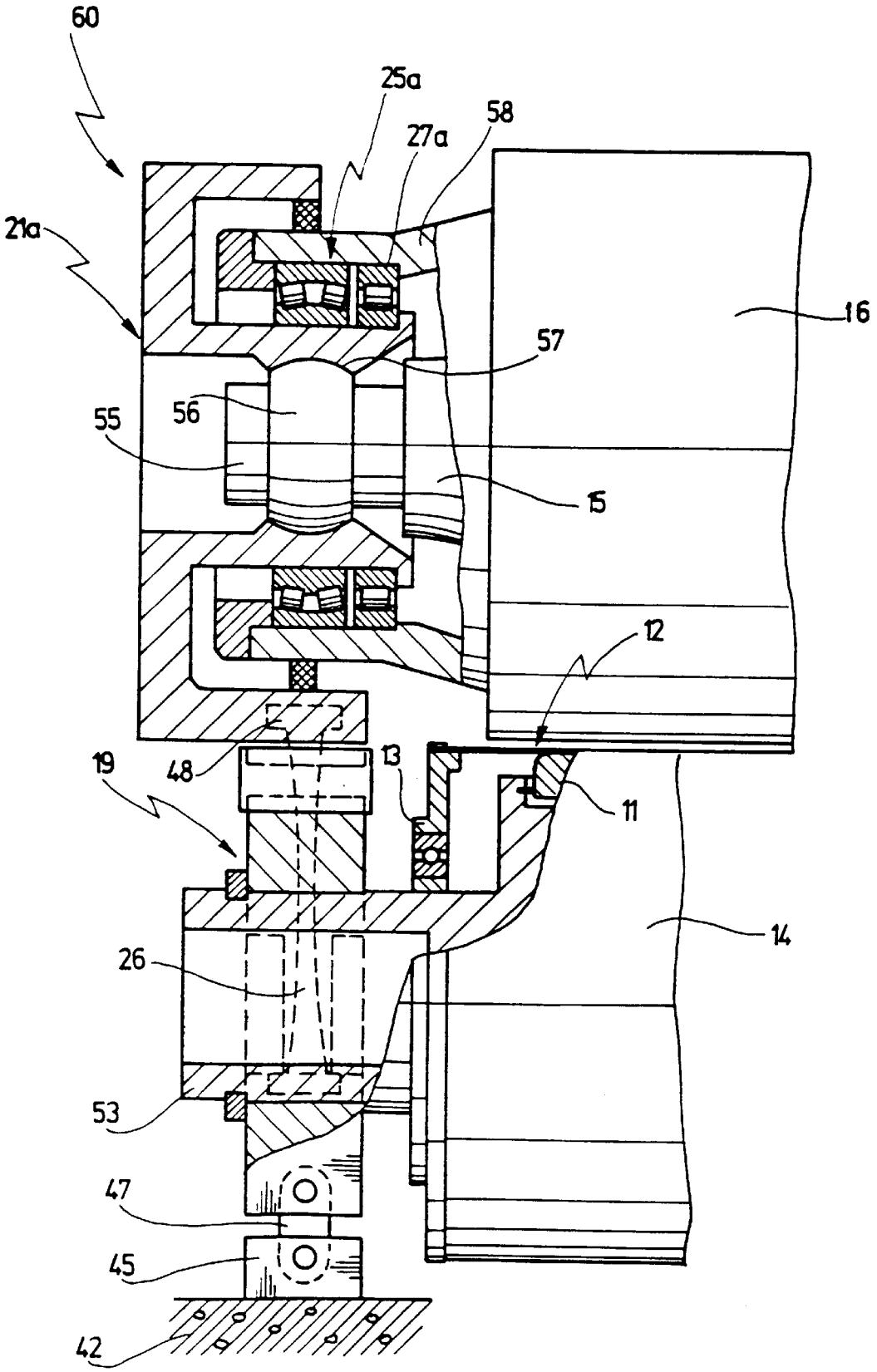
FIG. 3 shows an embodiment of the invention slightly modified as compared to the embodiment according to FIG. 1.

In FIG. 3, a modification of the embodiment depicted in FIGS. 1 and 2 is indicated generally by reference numeral 60; identical reference numbers are used for corresponding parts. Press apparatus 60 differs from the previously described embodiment essentially in that instead of a rotary bearing that allows accommodation of tilting moments, a rotary bearing 25 is provided that is common in conventional arrangements and is configured as a self-aligning bearing. In order to fix second bearing blocks 21*a* in position, additional support bearings 27*a* are provided, by means of which second bearing blocks 21*a* are aligned coaxially with the ends of roll shell 58. Otherwise the embodiment according to FIG. 3 corresponds entirely to the embodiment described previously with reference to FIGS. 1 and 2.

Figure 4:
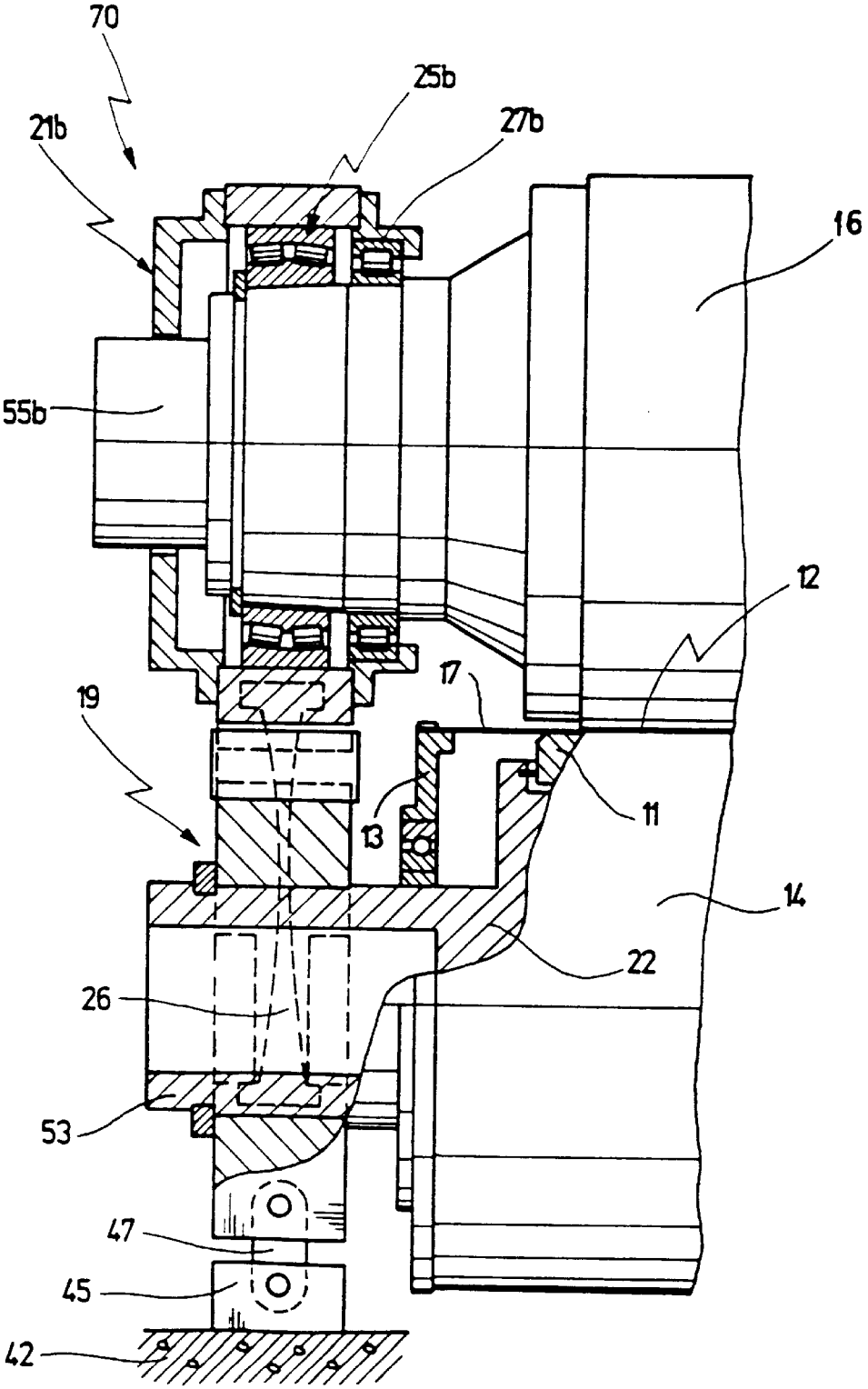
FIG. 4 shows a further modification of the invention in a partly sectioned front view of the guide side, the opposing roll being configured as a solid roll.

A further modification of the invention is depicted in FIG. 4 and labeled in its entirety with the number 70. Once again, identical reference numbers are used for corresponding parts.

In this embodiment, second press roll 16 is embodied as a solid roll, which may be the case, for example, if the paper-making machine has a smaller web width, so that overall a lesser deflection may be expected for the same linear force, so that a simpler embodiment as a solid roll is sufficient.

In this case, therefore, second press roll 16 is rotatably mounted at each end, with its end bearing pin 55*b*, directly on second bearing block 21*b* by means of a rotary bearing 25*b*.

Since bearing pins 55*b* deflect only slightly because second press roll 16 is quasi-deflection-free, and moreover only very low frictional forces are generated in the rotating rotary bearings 25*b*, which are configured as self-aligning bearings, as a result only small tilting moments are exerted on second bearing blocks 21*b*, so that as such, no additional fixing in position of the second bearing blocks would be necessary. If, however, external accessories are fastened directly onto second bearing blocks 21, for example scrapers, felt guide rolls, and the like, this would in turn lead, because of the axial compensation of the external accessories that is accompanied by friction, to tilting of the second bearing blocks, which in turn would result in excessive bending stress on tension elements 26.

For these reasons, according to the invention additional support bearings 27*b* are provided on bearing pins 55*b* of second press roll 16, in order to align second bearing blocks 21*b* coaxially with bearing pins 55*b*. Once again it would be possible, instead of this configuration in which rotary bearings 25*b* are configured as self-aligning roller bearings, to use rotary bearings that can transfer the tilting moments.

Figure 5:
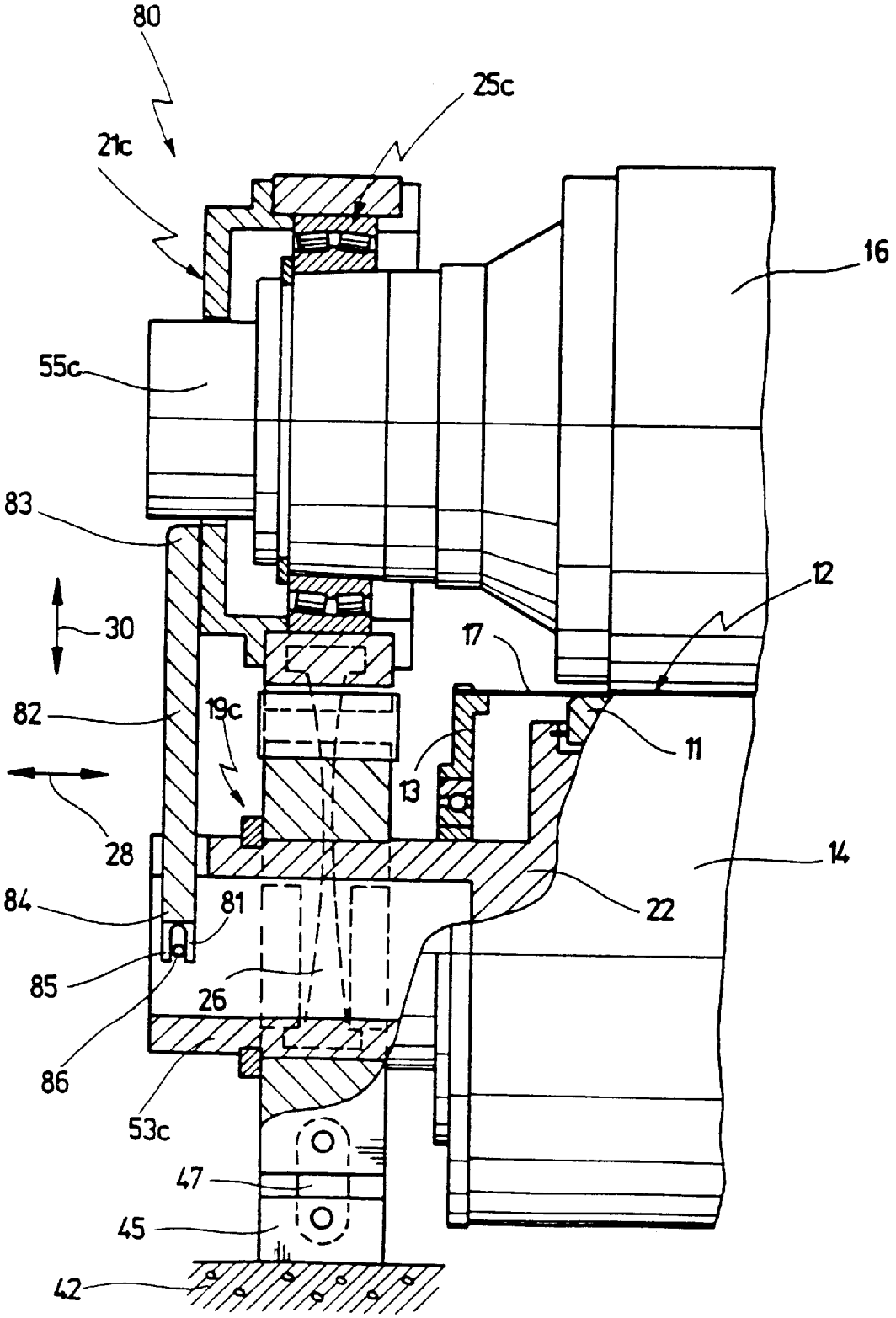
FIG. 5 shows a further modification of the invention in a partly sectioned front view of the guide side, the upper bearing block being secured against tilting by means of a link that is displaceably guided on the lower bearing block.
Figure 6:
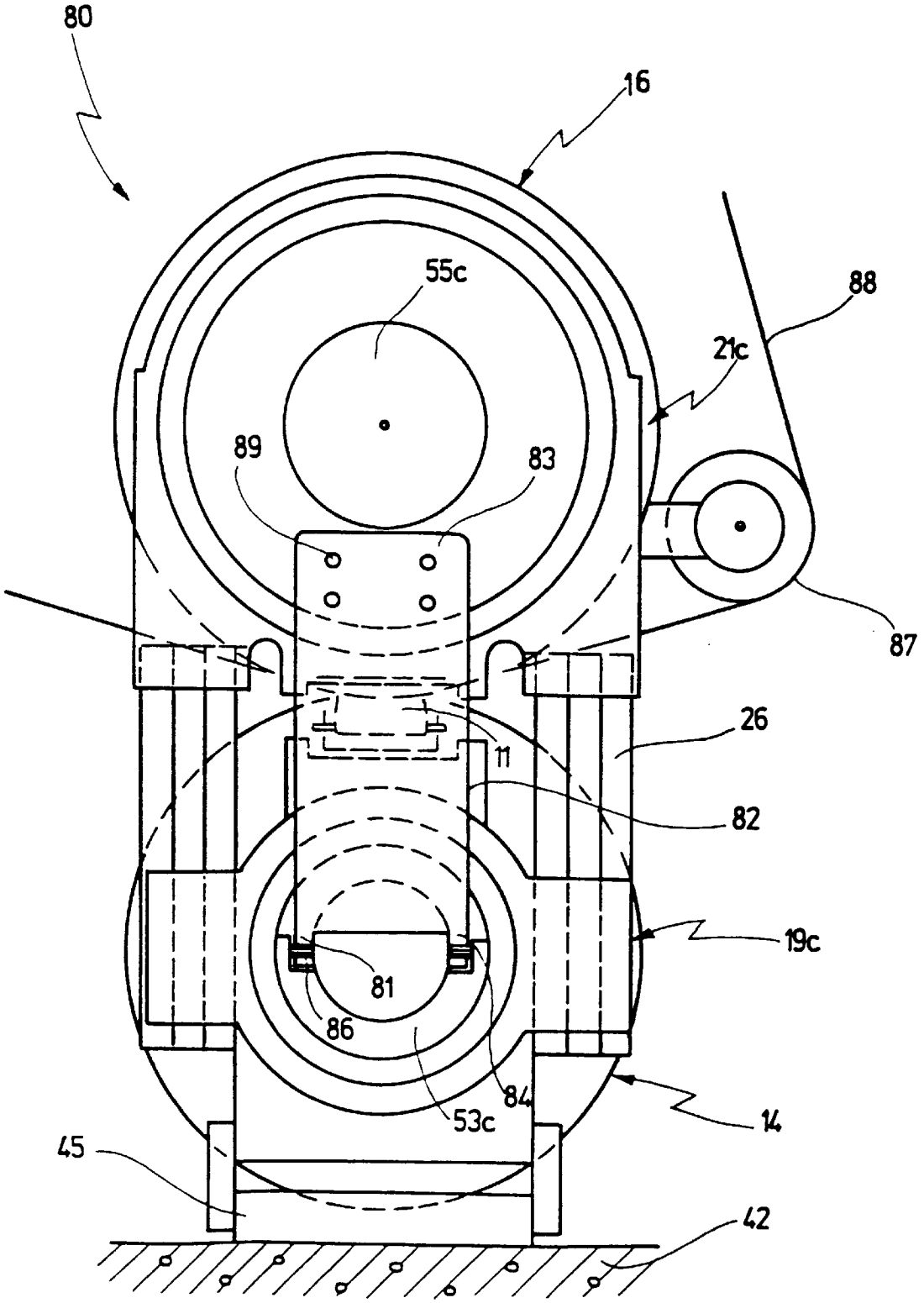
FIG. 6 shows a side view of the embodiment according to FIG. 5 in a simplified depiction.

A further embodiment of the invention is depicted in FIGS. 5 and 6 and labeled as a whole with the number 80. Once again, identical reference numbers are used for corresponding parts.

Press apparatus 80 comprises an upper press roll 16 that is configured as a solid roll, and a lower press roll 14 that is configured as a shoe press roll in the manner described previously.

The second, upper press roll 16 is mounted with each of its two bearing pins 55*c*, in the manner described above with reference to FIG. 4, in second bearing blocks 21*c* by means of a self-aligning roller bearing 25*c*.

In contrast to the embodiment according to FIG. 4, however, no support bearing is provided in order to accommodate tilting moments.

In order to prevent tilting of upper bearing blocks 21*c* with respect to the first, lower bearing blocks 19*c*, instead of this a link 82 guided on first bearing block 19*c* is fastened in each case on second bearing block 21*c*.

Link 82, configured substantially as a plate, is in each case connected at its upper end 83, via bolts 89, to the respective second bearing block 21*c*.

Link 82 has at its second, lower end two outer extensions 81 pointing downward, inside each of which is constituted a groove 85, in each of which a pin 86, fastened to bearing pin 53*c*, is guided.

Each link 82 is thus rigidly connected to a second bearing block 21*c* and at its second, lower end 84 is fixed in the horizontal direction 28 on bearing pin 53*c*, but is displaceably guided in vertical direction 30.

While only guide side 40 is depicted in FIG. 5, on the drive side (not depicted in the drawing) of press apparatus 80 there is also provided on the upper, second bearing block a corresponding link which is retained in the axial direction in a guide on the first, lower bearing block but is guided displaceably in the vertical direction.

In addition, there is provided on the drive side an articulated connection between the second bearing block and the first bearing block, corresponding to the embodiment according to FIG. 2, which engages in the middle of the longitudinal extension of the tension elements. This additional sliding articulated joint is necessary in order to prevent second press roll 16 from escaping in axial direction 28 toward the drive side or the guide side, since tension elements 26 alone cannot accommodate any bending forces (otherwise kinematically, a four-link drive train would be present).

Bending overload of the tension elements due to tilting of the second bearing blocks or due to axial movements of second press roll 16 is thus prevented.

Figure 7:
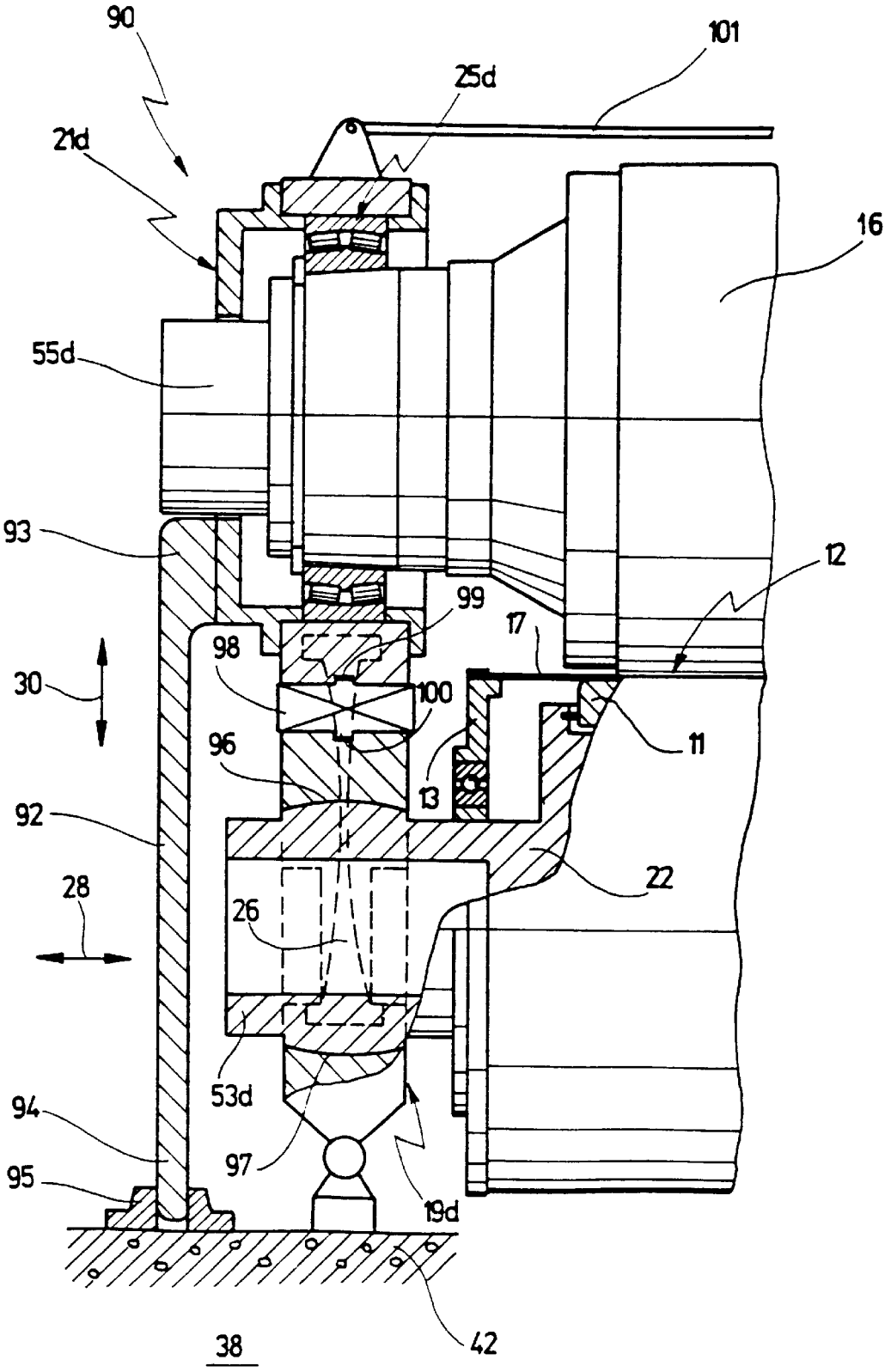
FIG. 7 shows a modification of the embodiment according to FIG. 5, the bearing block of the upper press roll being guided by means of a link directly on the base.

In an alternative embodiment, the attachment of the second bearing block to the first bearing block by means of the link could be provided only on one side of press apparatus 80, preferably on the drive side, while second bearing block 21*c* on guide side 40 of press apparatus 80 is connected to the other second bearing block by a horizontal connecting element 101 according to FIG. 7, and thereby secured against tilting.

FIG. 6 additionally shows a second bearing block 21*c*, over which felt 88 is guide in a known manner together with the pulp web being dewatered. A felt guide roll 87 of this kind requires a non-locating bearing on the one side to allow compensation for changes in length with respect to the second press roll during operation. This length compensation is accompanied by some degree of friction and, when compensation movements occur, generates tilting moments about the center point of self-aligning roller bearing 25*c* which are accommodated by the construction described above.

A further modification of the press apparatus according to the invention is depicted in FIG. 7 and labeled in its entirety with the number 90. Once again, identical reference numbers are used for corresponding parts.

Once again the second, upper press roll 16 is configured as a solid roll that is mounted by means of a self-aligning roller bearing 25*d* at both bearing pins 55*d* on second bearing blocks 21*d*.

The first, lower press roll 14 is once again configured as a shoe press roll, although in a modification of the embodiment described above, it is mounted with its bearing pins 53*d*, each by means of a collar 97, in a spherical bushing 96 of the respective first bearing block 19*d*.

With this embodiment one of the first bearing blocks, preferably on the drive side 38, is configured as a locating bearing and fastened, as indicated in FIG. 2, to base 42 via an articulated joint. Thus on drive side 38, only swiveling or "skewing" of first bearing block 19*d* is possible, but no movement in axial direction 28. The opposite side, the guide side, is fastened to the base via a non-locating bearing. (In contrast to the embodiments described previously, in FIG. 7 drive side 38 is depicted on the left side of press apparatus 90.)

The upper, second bearing block 21*d* is secured against axial displacements by means of a gated guide 98 that is arranged directly between upper bearing block 21*d* and lower bearing block 19*d*. This gated guide 98 has at both the upper and lower end a strip 100, extending transversely to the axial direction, that engages in a groove 99 on upper bearing block 21*d* and on lower bearing block 19*d*.

This is an alternative embodiment to articulated connection 32 that was explained with reference to FIG. 2.

A gated guide 98 of this kind is provided only on drive side 38. A certain disadvantage of this gated guide 98 consists in the fact that in contrast to the embodiment according to FIG. 2, the axial attachment between the two bearing blocks 19*d* and 21*d* engages not exactly in the middle of the longitudinal extension of tension elements 26, but at the upper end.

But as long as second press roll 16, i.e. the opposing roll to shoe press roll 14, is configured as a solid roll, the tilting moments which occur at second bearing blocks 21*d* are relatively small, so that a not entirely uniform distribution of the bending load over tension elements is not absolutely necessary.

In the embodiment according to FIG. 7, in order to accommodate tilting moments a link 92 is retained at its upper end 93 to upper bearing block 21*d*, for example by means of bolts (not depicted).

In contrast to the embodiment described previously with reference to FIGS. 5 and 6, link 92 is guided at its lower end 94 not on the respective first bearing block located below, but directly on a guide 95 that is retained in stationary fashion on base 42. Slide guide 95 permits displacements in vertical direction 30, but retains lower end 94 of link 92 in the axial direction.

Overall, the combination of link 92 with gated guide 98 secures upper bearing block 21*d* on drive side 38 against tilting and against axial displacements.

On the guide side opposite, corresponding securing can also be provided by means of a link 92.

In FIG. 7, however, in an alternative embodiment, instead of a link of this kind to secure the upper bearing block on the drive side, only a horizontal connecting element 101 is provided between the two upper bearing blocks 21*d* in the form of a crossbar, so that because the drive-side bearing block 21*d* is held in non-tilting fashion, the guide-side second bearing block is also secured against tilting.

Figure 8:
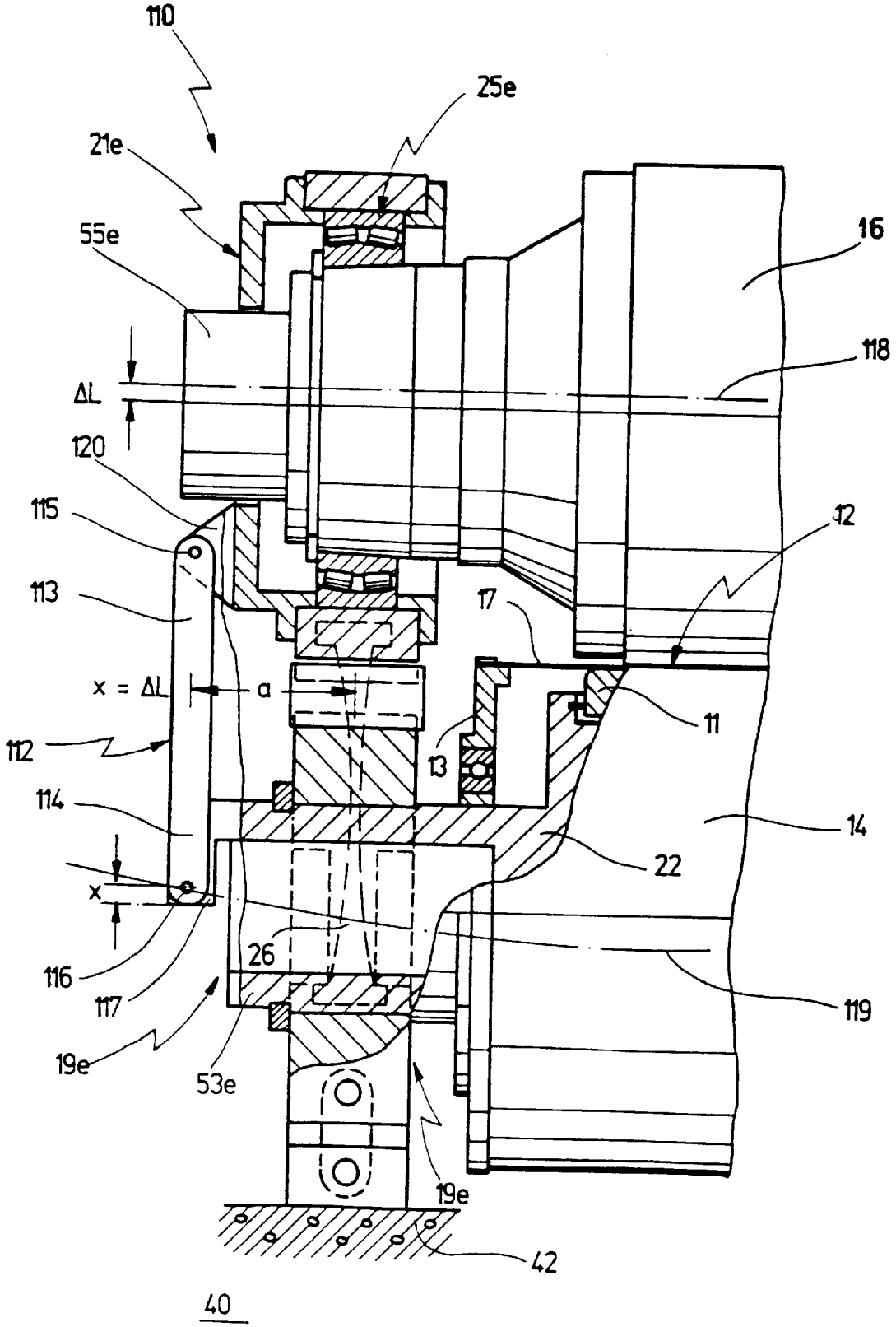
FIG. 8 shows a further embodiment of the invention in which the opposing bearing blocks are interconnected in articulated fashion by means of a bracket.

A further modification of the previously described embodiment of the press apparatus according to the invention is depicted in FIG. 8 and labeled in its entirety with the number 110.

Here the upper, second press roll 16 is once again configured as a solid roll, and mounted rotatably at both bearing pins 55*e*, by means of self-aligning roller bearings 25*e*, on second bearing blocks 21*e*.

First press roll 14 is once again configured as a shoe press roll, and mounted with its two bearing pins 53*e* directly (without the use of spherical bushings) in first bearing blocks 19*e*, as has already been described above with reference to FIG. 5.

Guide side 40 is once again depicted in FIG. 8.

In contrast to the embodiment according to FIG. 5, tilting of second bearing blocks 21*e* is prevented not by providing links that are displaceably guided on first bearing blocks 19*e*, but rather the upper, second bearing blocks 21*e* are each connected in articulated fashion to first bearing blocks 19*e* located below, on both sides of press apparatus 110, via brackets 112. Each bracket is configured as a rigid connecting bar that is connected at its first, upper end 113 via an articulated joint 115 to a receptacle 120 that is fastened to second bearing block 21*e*. Bearing pin 53*e* of lower press roll 14 has a projection 117 to which lower end 114 of bracket 112 is in turn fastened by means of an articulated joint 116.

A bracket connection of this kind is provided at both ends of press apparatus 110. Additionally, an articulated connection 32 according to FIG. 2 is provided on the guide side in order to achieve axial retention.

In order to ensure, when press apparatus 110 is loaded with the nominal pressing force in press nip 12, that second bearing blocks 21*e* are not tilted and thus that bending overload of tension elements 26 does not occur, brackets 112 must be at a distance a from the center of tension elements 26 such that the elongation ΔL of tension elements 26 resulting from the pressing force corresponds exactly to the displacement X experienced by each bracket 112 as a result of the deflections of the two press rolls 14, 16 at bearing pins 53*e* and 55*e*, respectively. The distance a between brackets 112 and tension elements 26 must therefore be dimensioned specifically for each system in order to prevent tilting of second bearing blocks 21*e*.

FIG. 8 indicates, for illustration, the distance ΔL resulting from the elongation of tension elements 26 under load, which leads to a corresponding upward shift of rotation axis 118 of second press roller 16. First press roll 14, which in the example depicted is configured as a shoe press roll, suffers a deflection of its stationary support 22, which leads to a corresponding skewing of bearing pin 53*e*, as indicated by dot-dash line 119. The resulting upward displacement of bracket 112 at articulated joints 115, 116 must correspond approximately to the shift ΔL of rotation axis 118 of second press roll 16 (measured in the prolongation of tension elements 26).

A design of this kind ensures that both bearing blocks of upper press roll 16 are held in non-tilting fashion at the nominal load, thus preventing bending overload of tension elements 26.

In an alternative embodiment, the device according to FIG. 8 can also be provided only on the drive side, while a horizontal connecting element 101 according to FIG. 7 connects the two upper bearing blocks and thus also secures the guide-side bearing block against tilting.

If, in a modification to the embodiment depicted, second press roll 16 is embodied as a deflection compensated roll (cf. FIG. 3), greater frictional torques and therefore greater tilting moments occur because spherical bushings are used for mounting. Brackets 112 must then be more robustly dimensioned in a suitable manner.

It is understood that in addition to the configurations of the press apparatuses depicted, with "floating" opposing rolls, numerous other configurations are also possible without leaving the context of the invention.

We claim:

1. An extended nip press for dewatering a pulp web in a paper-making machine, comprising:

a first press roll and a second press roll forming an extended nip therebetween;

first bearing blocks for holding first bearing pins provided on said first press roll;

means for retaining the first press roll in axial direction at one end thereof;

second bearing blocks for holding second bearing pins provided on a stationary yoke arranged on said second press roll;

a roll shell mounted by means of rotary bearings on said second press roll rotatably with respect to saidsecond bearing blocks;

tension elements arranged between said first and said second bearing blocks for securing said first and said second bearing blocks with respect to one another, said tension elements made and designed to receive tensioning forces between said first and said second bearing blocks and to allow a relative displacement between said first and second press rolls in axial direction thereof; and means for accommodating tilting moments which are exerted on said second bearing blocks.

2. The extended nip press of claim 1, further comprising support bearings for holding said rotary bearings in non-tilting fashion.

3. The extended nip press of claim 1, wherein said rotary bearings are configured as bearings which can accommodate tilting moments.

4. The extended nip press of claim 3, wherein the rotary bearings are configured as double-row tapered roller bearings in an O arrangement.

5. The extended nip press of claim 1, further comprising a link having a first end which is rigidly fastened to one of said second bearing blocks, and having a second end which engages a guide provided in stationary fashion on one of said first bearing blocks and which further secures said second end against displacements in axial direction, but permits displacements in a vertical direction.

6. The extended nip press of claim 1, further comprising a bracket arranged on one of said first and second bearing blocks, said bracket being configured as a rigid connecting element comprising articulated joints at each end thereof for connecting said one bearing block with a bearing pin of another one of said first and second bearing blocks, said rigid connecting element arranged with a spacing with respect to one of said tension elements, said spacing being dimensioned such that, when the press is under load, a change in length of said tension elements resulting from a pressing force corresponds substantially to a displacement of said articulated joints of said bracket which is caused by a deflection of said press rolls.

7. The extended nip press of claim 1, further comprising a horizontal connecting element for coupling one of said first bearing blocks to one of said second bearing blocks.

8. The extended nip press of claim 1, wherein one of the second bearing blocks is secured against displacements in axial direction to one of the first bearing blocks.

9. The extended nip press of claim 1, wherein said tension elements are deformable in flexurally elastic fashion in the axial direction of said press rolls, and at each of their ends are rigidly clamped to one of the first or second bearing blocks, respectively.

10. The extended nip press of claim 1, wherein said means for accomodating tilting moments comprises an articulated connection between one of the first and one of said second bearing blocks, said articulated connection being fixed in the axial direction of the press rolls, but movable in a longitudinal direction of said tension elements.

11. The extended nip press of claim 10, wherein said articulated connection is arranged approximately in the middle of the longitudinal extension of said tension elements.

12. The extended nip press of claim 11, wherein said articulated connection comprises a pin which is held, displaceably in the vertical direction, inside a guide.

13. The extended nip press of claim 1, further comprising a gated guide for coupling one of the second bearing blocks to one of the first bearing blocks, said gated guide being movable in vertical direction but fixed in the axial direction of said press rolls.

14. An extended nip press for dewatering a pulp web in a paper-making machine, comprising:

a first press roll and a second press roll forming an extended nip therebetween;

first bearing blocks for holding first bearing pins provided on said first press roll;

means for retaining the first press roll in axial direction at one end thereof;

second bearing blocks for holding second bearing pins provided on said second press roll;

rotary bearings for mounting said second bearing pins rotatably on said second bearing blocks;

tension elements arranged between said first and said second bearing blocks for securing said first and said second bearing blocks with respect to one another, said tension elements made and designed to receive tensioning forces between said first and said second bearing blocks and to allow a relative displacement between said first and second press rolls in axial direction thereof; and means for accommodating tilting moments which are exerted on said second bearing blocks.

15. The extended nip press of claim 14, further comprising a link having a first end which is rigidly fastened to one of said second bearing blocks, and having a second end which engages a guide provided in stationary fashion on one of said first bearing blocks and which further secures said second end against displacements in axial direction, but permits displacements in a vertical direction.

16. The extended nip press of claim 15, further comprising a bracket arranged on one of said first and second bearing blocks, said bracket being configured as a rigid connecting element comprising articulated joints at each end thereof for connecting said one bearing block with a bearing pin of another one of said first and second bearing blocks, said rigid connecting element arranged with a spacing with respect to one of said tension elements, said spacing being dimensioned such that, when the press is under load, a change in length of said tension elements resulting from a pressing force corresponds substantially to a displacement of said articulated joints of said bracket which is caused by a deflection of said press rolls.

17. The extended nip press of claim 15, further comprising a horizontal connecting element for coupling one of said first bearing blocks to one of said second bearing blocks.

18. The extended nip press of claim 15, wherein one of the second bearing blocks is secured against displacements in axial direction to one of the first bearing blocks.

19. The extended nip press of claim 15, wherein said tension elements are deformable in flexurally elastic fashion in the axial direction of said press rolls, and at each of their ends are rigidly clamped to one of the first or second bearing blocks, respectively.

20. The extended nip press of claim 15, wherein said means for accomodating tilting moments comprises an articulated connection between one of the first and one of said second bearing blocks, said articulated connection being fixed in the axial direction of the press rolls, but movable in a longitudinal direction of said tension elements.

21. The extended nip press of claim 20, wherein said articulated connection is arranged approximately in the middle of the longitudinal extension of said tension elements.

22. The extended nip press of claim 21, wherein said articulated connection comprises a pin which is held, displaceably in the vertical direction, inside a guide.

23. The extended nip press of claim 15, further comprising a gated guide for coupling one of the second bearing blocks to one of the first bearing blocks, said gated guide being movable in vertical direction but fixed in the axial direction of said press rolls.

24. The extended nip press of claim 15, further comprising support bearings for holding said rotary bearings in non-tilting fashion.

25. The extended nip press of claim 24, wherein said rotary bearings are configured as bearings which can accommodate tilting moments.

26. The extended nip press of claim 25, wherein the rotary bearings are configured as double-row tapered roller bearings in an O arrangement.

* * * * *